US010341778B2

(12) United States Patent
Liu et al.

(10) Patent No.: US 10,341,778 B2
(45) Date of Patent: Jul. 2, 2019

(54) MULTIFUNCTIONAL DEVICE WITH VIBRATION FUNCTION AND SOUND GENERATION FUNCTION

(71) Applicant: Goertek Inc., Shandong (CN)

(72) Inventors: Chunfa Liu, Shandong (CN); Chao Xu, Shandong (CN); Jizong Wang, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 15/750,602

(22) PCT Filed: May 9, 2016

(86) PCT No.: PCT/CN2016/081382

§ 371 (c)(1),
(2) Date: Feb. 6, 2018

(87) PCT Pub. No.: WO2017/117891

PCT Pub. Date: Jul. 13, 2017

(65) Prior Publication Data

US 2019/0020954 A1 Jan. 17, 2019

(30) Foreign Application Priority Data

Jan. 4, 2016 (CN) ..... 2016 1 0004383

(51) Int. Cl.
*H04R 9/02* (2006.01)
*H04R 1/02* (2006.01)
(Continued)

(52) U.S. Cl.
CPC ..... *H04R 9/025* (2013.01); *H04R 1/02* (2013.01); *H04R 9/043* (2013.01); *H04R 9/06* (2013.01); *H04R 2400/03* (2013.01)

(58) Field of Classification Search
CPC ..... H04R 9/02; H04R 9/025; H04R 9/043; H04R 9/06; H04R 2209/024; H04R 2400/03; H04R 2400/07; H04R 2400/11
See application file for complete search history.

(56) References Cited

U.S. PATENT DOCUMENTS

2006/0266967 A1* 11/2006 Miura ..... B06B 1/045 251/129.15
2007/0236088 A1* 10/2007 Miura ..... B06B 1/045 310/15

(Continued)

FOREIGN PATENT DOCUMENTS

CN 202172489 U 3/2012
CN 103763667 A 4/2014

(Continued)

OTHER PUBLICATIONS

International Searching Authority, International Search Report (ISR) and Written Opinion for International Application No. PCT/CN2016/081382, dated Jul. 27, 2016, 9 pages, State Intellectual Property Office of the P.R.C.

*Primary Examiner* — Joshua Kaufman
(74) *Attorney, Agent, or Firm* — Alston & Bird LLP

(57) ABSTRACT

A multifunctional device is provided, having vibration and sound generation functions, comprising a housing, a vibration system, a magnetic circuit system and an elastic support which are accommodated inside the housing, wherein the magnetic circuit system is support by the elastic support and is suspended inside the housing; the vibration system comprises a vibration diaphragm and a voice coil coupled to one side of the vibration diaphragm; and wherein the elastic support comprises a first fixing portion, second fixing portion, and a deformation portion which is connected between the first and second fixing portions; an orthographic projection of an outer contour of the elastic support in a vibration (Continued)

direction is in a shape of a polygon defined by straight lines or a geometrical shape defined by straight lines and arc lines; and the first fixing portion and the second fixing portion have a height difference there-between.

10 Claims, 4 Drawing Sheets

(51) Int. Cl.
*H04R 9/04* (2006.01)
*H04R 9/06* (2006.01)

(56) References Cited

U.S. PATENT DOCUMENTS

| | | | | |
|---|---|---|---|---|
| 2014/0056463 | A1* | 2/2014 | Kim ..... | H04R 9/043<br>381/398 |
| 2015/0188398 | A1 | 7/2015 | Zhang et al. | |

FOREIGN PATENT DOCUMENTS

| | | | |
|---|---|---|---|
| CN | 105472491 | A | 4/2016 |
| CN | 105491489 | A | 4/2016 |
| CN | 105516864 | A | 4/2016 |
| CN | 105516868 | A | 4/2016 |
| WO | WO 2012/108581 | A | 8/2012 |

* cited by examiner

MULTIFUNCTIONAL DEVICE WITH VIBRATION FUNCTION AND SOUND GENERATION FUNCTION

CROSS-REFERENCE TO RELATED APPLICATIONS

This application is a National Stage of International Application No. PCT/CN2016/081382, filed on May 9, 2016, which claims priority to Chinese Patent Application No. 201610004383.9, filed on Jan. 4, 2016, both of which are hereby incorporated by reference in their entireties.

BACKGROUND

Technical Field

The present invention relates to the field of electroacoustics, and in particular, to a multifunctional device having a vibration function and a sound generation function.

Description of Related Art

The existing mobile terminal electronic device (for example, a mobile phone) not only needs to be equipped with a speaker unit therein for generating sound, but also needs to be equipped with a vibration motor to perform vibration feedback on a user in consideration of the need for some quiet occasions, thereby realizing instant prompts, such as incoming calls and messages. However, since the current electronic products are becoming more lightweight and thinner, it will undoubtedly occupy more space if a vibration unit and a sound generation unit are assembled on a terminal product (for example, a mobile phone) of which an assembly space is relatively smaller. In order to solve this problem, people design a multifunctional acoustic element to satisfy the vibration function and the sound generation at the same time so as to reduce the space occupied by the acoustic element.

In the existing multifunctional acoustic element structure, an elastic support for supporting a magnetic circuit system is mostly a planar sheet-shaped or plate-shaped structure. A magnet of the magnetic circuit system is arranged in the middle of the elastic support. On one hand, the elastic support occupies much horizontal space inside a shell, limits the size of the magnet and is not conducive to increasing the BL value of the multifunctional acoustic element. On the other hand, since an elastic arm of the horizontal elastic support has a limited extension space, it is only possible to reduce the width of the elastic arm in order to adjust the vibration F0 value of the multifunctional acoustic element. The reliability of the horizontal elastic support will be reduced if the elastic arm is narrowed. When the multifunctional acoustic element is suffered by a large mechanical impact force, the elastic arm is easy to break and affect the product's performance. Therefore, on account of the above-mentioned problems, it is necessary to provide a novel elastic support which can neither limit the size of the magnet in the magnetic circuit system nor limit the length and width of the elastic arm.

BRIEF SUMMARY

The technical problem to be solved by the present invention is to provide a multifunctional device having a vibration function and a sound generation function. An elastic support of the multifunctional device can neither limit the size of a magnet in a magnetic circuit system nor limit the length and width of an elastic arm of the elastic support.

In order to achieve said objective, the present invention adopts the following technical solution. A multifunctional device having a vibration function and a sound generation function comprises a housing, as well as a vibration system, a magnetic circuit system and an elastic support which are accommodated inside the housing, wherein the magnetic circuit system is supported and fixed by the elastic support and is suspended inside the housing. The vibration system comprises a vibration diaphragm and a voice coil coupled to one side of the vibration diaphragm. The elastic support comprises a first fixing portion, a second fixing portion, and a deformation portion which is connected between the first fixing portion and the second fixing portion. An orthographic projection of an outer contour of the elastic support in a vibration direction is in a shape of a polygon defined by a plurality of straight lines or a geometrical shape defined by straight lines and arc lines. The first fixing portion and the second fixing portion have a height difference therebetween.

As an improvement, the orthographic projection of the outer contour of the elastic support in the vibration direction is of a rectangular or oblong structure. The first fixing portion or the second fixing portion is located at the edge of the elastic support, and is at least provided with a group of straight sides which face each other. The straight sides correspond to a group of straight sides, which face each other, of a bottom wall of the magnetic circuit system or the housing.

As an improvement, the first fixing portion is located in the middle of the elastic support, the second fixing portion is located at the edge of the elastic support, and four straight sides at the edges of the second fixing portion correspond to the straight sides of the rectangular bottom wall of the housing and are fixed to the edges of the bottom wall of the housing.

As an improvement, the second fixing portion is located in the middle of the elastic support, the first fixing portion is located at the edge of the elastic support, and four straight sides at the edges of the first fixing portion correspond to the straight sides of the rectangular bottom wall of the magnetic circuit system and are fixed to the edges of the bottom wall of the magnetic circuit system.

As an improvement, the housing is made of a metal material and comprises an upper housing and a lower housing. The elastic support is arranged between the lower housing and the magnetic circuit system. The first fixing portion or the second fixing portion is coupled to the bottom wall of the lower housing by laser welding.

As an improvement, an injection-molded part which is integrally formed by injection molding is arranged at the corner of the metal housing. A position, corresponding to the corner of the housing, of the elastic support is provided with a make-way structure. The orthogonal projection of the outer contour of the elastic support in the vibration direction is octagonal.

As an improvement, the elastic support is of a spring-shaped structure, and the deformation portion is an arc-shaped elastic arm.

As an improvement, arcuate transition portions which reduce the stress concentration are arranged at the junctions between the deformation portion and the first and second fixing portions.

As an improvement, the vibration and sound generation device further comprises a mass block which is coupled to the magnetic circuit system. The magnetic circuit system comprises a flat magnetic conduction yoke. A magnet is coupled to the center of the magnetic conduction yoke. The mass block which is of a closed loop structure is coupled to the edge of the magnetic conduction yoke.

As an improvement, the magnetic conduction yoke is coupled to the first fixing portion or the second fixing portion by welding. A welding position, corresponding to the magnetic conduction yoke and the elastic support, on the bottom wall of the lower housing is provided with welding make-way holes.

Compared with the prior art, the elastic support of the multifunctional device of the present invention comprises the first fixing portion, the second fixing portion, and the deformation portion which is connected between the first fixing portion and the second fixing portion, the orthogonal projection of the outer contour of the elastic support in the vibration direction is in a shape of a polygon defined by a plurality of straight lines or a geometrical shape defined by straight lines and arc lines, and the first fixing portion and the second fixing portion have a height difference therebetween.

First, the elastic support of the multifunctional device of the present invention is arranged between the magnetic circuit system and the bottom wall of the housing, without occupying a horizontal space of the magnetic circuit system or limiting the size of the magnet in the magnetic circuit system. Therefore, a magnet having a larger size may be arranged in the vibration and sound generation device, a BL value of the multifunctional device is increased, and the product's sensitivity is improved.

Secondly, since the elastic support of the present invention is of a stereoscopic structure and the first fixing portion and the second fixing portion have a height difference therebetween, the length of the deformation portion which is connected between the first fixing portion and the second fixing portion may be set freely. The adjustment of the vibration F0 value of the vibration and sound generation device may be realized by lengthening the deformation portion, such that the deformation portion does not need to be narrowed, and the deformation portion may also be widened to increase the stability of the elastic support and prevent the deformation portion from being ruptured when the elastic support suffers from a large mechanical impact force.

Next, the orthogonal projection of the outer contour of the elastic support of the present invention in the vibration direction is in a shape of a polygon defined by a plurality of straight lines or a geometrical shape defined by straight lines and arc lines. Specifically, the projection may be rectangular or oblong. The elastic support having such a stereoscopic structure has higher vibration stability and reduces the probability of polarization in the vibration process.

The reference signs represent the following components: 1—upper housing; 2—lower housing; 21—bottom wall; 22—injection—molded part; 23—welding make—way hole; 3—magnetic conduction yoke; 4—magnet; 5—washer; 6—mass block; 7—voice coil; 8—vibration diaphragm; 9—reinforcing layer; 10—elastic support; 101—first fixing portion; 102—second fixing portion; 103—deformation portion; 104—make—way structure; 105—arcuate transition portion; 11—backing ring; 12—circuit board; 13—spring.

DETAILED DESCRIPTION OF VARIOUS EMBODIMENTS

Figure 1:
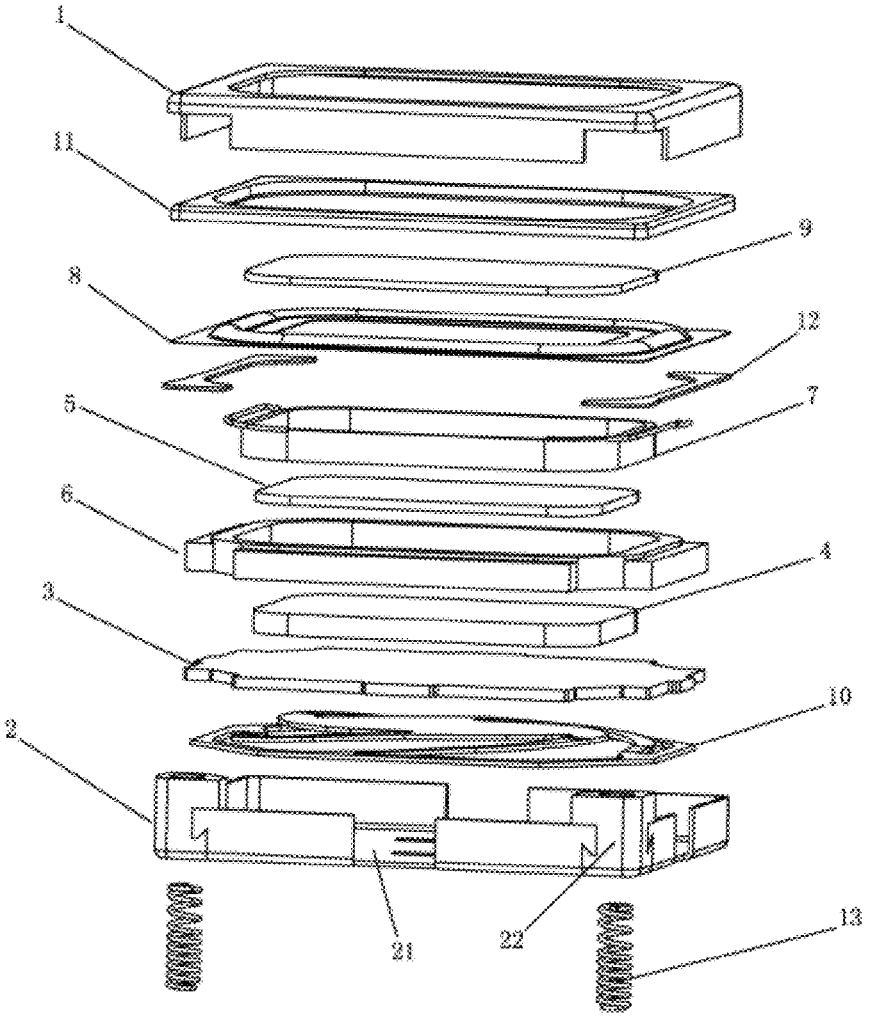
FIG. 1 is an exploded schematic structural view of a multifunctional device of the present invention.
Figure 2:
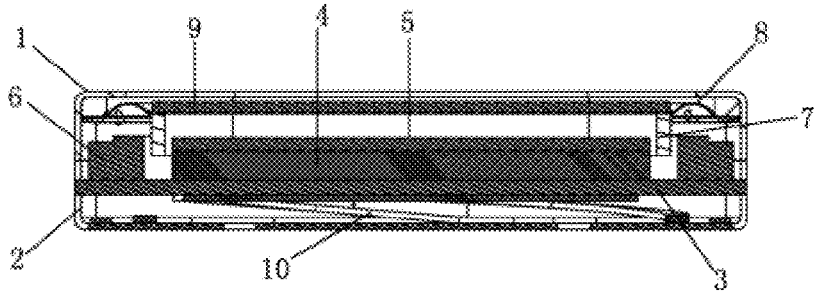
FIG. 2 is a sectional view of the multifunctional device of the present invention.

As shown in FIGS. 1 to 2, a multifunctional device having a vibration function and a sound generation function according to the present invention is of a rectangular structure and can realize the vibration function and the sound generation function at the same time. The multifunctional device comprises a housing. The housing has an accommodating space and accommodates a magnetic circuit system, a vibration system and an elastic support 10, wherein the magnetic circuit system comprises a magnetic conduction yoke 3, a magnet 4 fixed to the center of the magnetic conduction yoke by gluing, and a washer 5 attached to the surface of the magnet 4. It should be noted that the magnetic conduction yoke 3 here is designed into a flat structure which extends in a horizontal direction. A mass block 6 is also fixedly coupled to the edge of the magnetic conduction yoke 3. The mass block 6 is of a closed loop structure, surrounds the magnet 4 and is spaced from the magnet 4 by a certain distance to form a gap. The vibration system specifically comprises a voice coil 7 and a vibration diagram 8 fixedly coupled to one side of the voice coil 7. In order to enhance the acoustical performance of the multifunctional device at a high frequency, a reinforcing layer 9 is also coupled to the middle of the vibration diaphragm 8. One end of the voice coil 7 is suspended inside a gap between the magnet 4 and the mass block 6. The elastic support 10 has an elastic deformation space in a vertical direction for the vibrator to vibrate in the vertical direction.

As can be seen from the above structure, the magnetic circuit system and the mass block 6 form a vibrator of the vibration and sound generation device jointly, and the vibrator is supported and fixed by the elastic support 10 and is suspended in a space of the housing.

After the basic structure of the multifunctional device is illustrated, its working principle will be described as follows. After the above structure is assembled to a terminal product, such as a mobile phone or Pad, and is connected to an external circuit, the external circuit can provide the vibration and sound generation device an alternating current. However, since the resonant frequencies of a speaker and a vibration motor themselves are different, driving voltages for operating the speaker and the vibration motor are greatly different. For example, the resonant frequency of the motor is generally over 300 Hz, while the resonant frequency of a sound generation unit is 300 Hz or less; the voltage for driving the motor to vibrate only requires 0.35V, and the driving voltage of the sound generation unit may reach 2V or so. A filtering circuit in the terminal product, such as the mobile phone, may be configured to filter an external current signal to a range required by the vibration unit and a range required by the sound generation unit respectively, that is, the vibration unit may vibrate within a low frequency band, while the sound generation unit may generate sound mainly within a high frequency band. The principles upon which the vibration unit and the sound generation unit operate normally are implemented under the combined action of a current signal input into the sound coil 7 and the magnetic field: within the low frequency band, the voice coil 7 which is energized suffers from an Ampere force in the magnetic field of the magnet 4, and meanwhile provides a counteracting force which is equal in size and opposite in direction to the magnet 4, such that the magnet 4 reciprocates in an elastic deformation direction (the vertical direction) of the elastic support 10, thereby driving the magnetic conduction yoke 3 fixedly connected thereto, the washer 5 and the mass block 6 fixed to the magnetic conduction yoke 3 to vibrate together; within the high frequency band, the voice coil 7 which receives the current signal from the external circuit reciprocates to cut the magnetic lines of force under the action of the electromagnetic field, thereby driving the vibration diaphragm 8 to vibrate; the housing is provided with a sound aperture in a position over against the vibration diaphragm 8, and therefore acoustic waves can be irradiated outside from the sound aperture to realize sound generation.

According to the multifunctional device disclosed by the present invention, in order to solve the problems that the elastic support in the existing design limits the length and the width of the elastic arm itself and limits the size of the magnet, there is provided a novel elastic support. Specifically, as shown in FIGS. 1 to 6, the elastic support 10 comprises a first fixing portion 101, a second fixing portion 102, and a deformation portion 103 which is connected between the first fixing portion 101 and the second fixing portion 102. An orthographic projection of an outer contour of the elastic support 10 in a vibration direction is in the shape of a polygon defined by a plurality of straight lines or a geometrical shape defined by straight lines and arc lines. The first fixing portion 101 and the second fixing portion 102 have a height difference therebetween in the vertical direction. That is, the elastic support 10 is of a non-planar stereoscopic structure integrally.

Since the elastic support 10 of the present invention is arranged between the magnetic circuit system and the bottom wall of the housing and vibrates in a vertical direction, without occupying a horizontal space of the magnetic circuit system or limiting the size of the magnet 4 in the magnetic circuit system, a magnet having a large size may be arranged in the vibration and sound generation device, a BL value of the multifunctional device during vibration is increased, and the product's sensitivity is improved.

Secondly, since the elastic support 10 of the present invention is of a stereoscopic structure and the first fixing portion 101 and the second fixing portion 102 have a height difference therebetween in the vertical direction, the length of the deformation portion 103 which is connected between the first fixing portion 101 and the second fixing portion 102 may be set freely. The adjustment of the vibration F0 value of the vibration and sound generation device may be realized by lengthening the deformation portion 103, such that the deformation portion 103 does not need to be narrowed, and the deformation portion 103 may also be widened to increase the stability of the elastic support 10 and prevent the deformation portion from being ruptured when the elastic support suffers from a large mechanical impact force.

Figure 3:
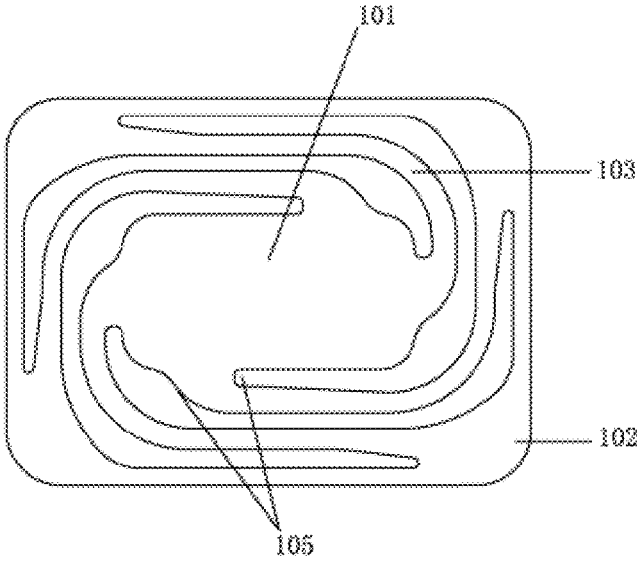
FIG. 3 is a top view of an elastic support of the multifunctional device of the present invention.
Figure 4:
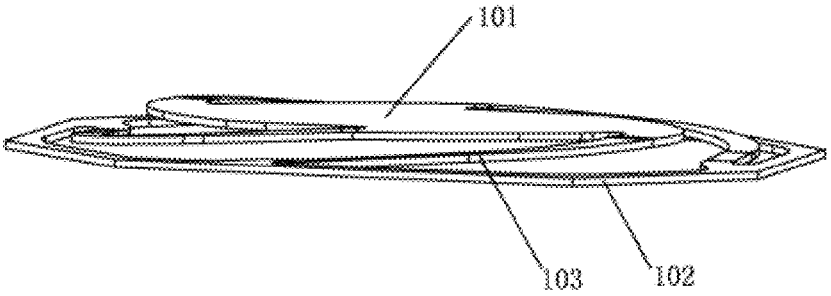
FIG. 4 is a side view of the elastic support of the multifunctional device of the present invention.
Figure 5:
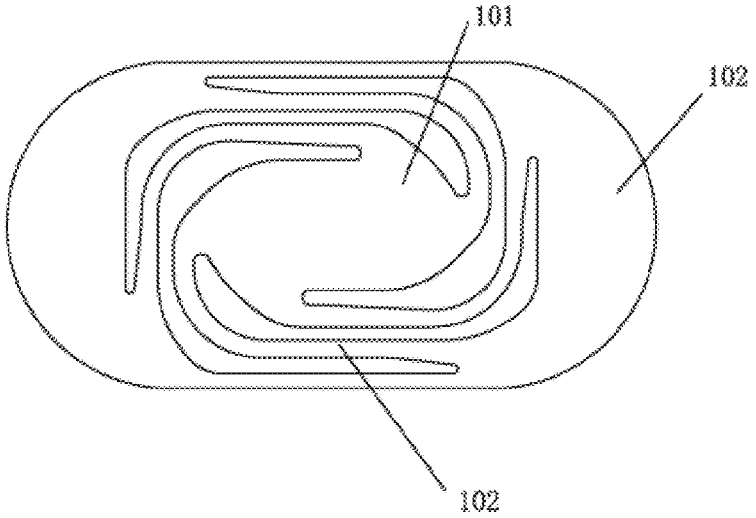
FIG. 5 is a schematic view of an oblong structure of the elastic support of the multifunctional device of the present invention.
Figure 6:
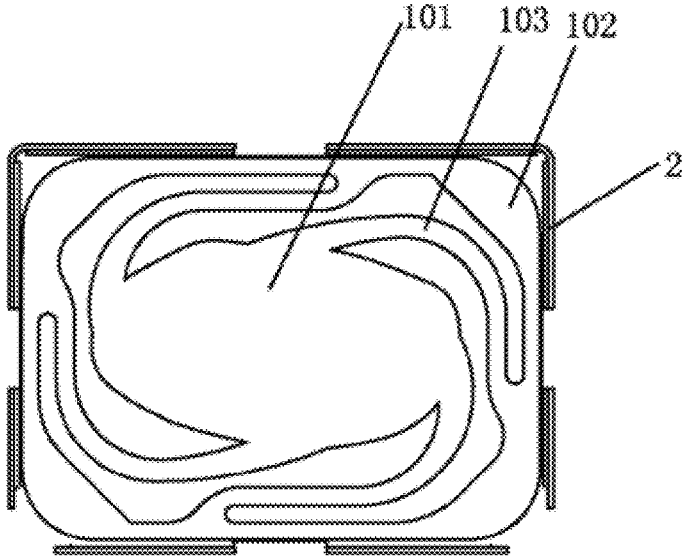
FIG. 6 is a schematic view of a positional relationship of the elastic support and a housing of the multifunctional device of the present invention.

Preferably, the orthogonal projection of the outer counter of the elastic support 10 in the vibration direction is rectangular or oblong. The first fixing portion 101 or the second fixing portion 102 is located at the edge of the elastic support 10, and four straight sides of the first fixing portion 101 or the second fixing portion 102 correspond to the rectangular bottom wall of the magnetic circuit system or the housing. As shown in FIGS. 3 and 6, the orthogonal projection of the outer contour of the elastic support 10 in the vibration direction is rectangular, and the rectangular shape here may be a rectangle or a square, which comprises four straight sides. The rectangle may be an approximate rectangle and may not be limited to a structure in which any included angle is a right angle, wherein chamfers (reversed fillets or reversed "C" angles) may be arranged at the corners, and the straight sides may also be provided with small protrusions or recesses, etc. As shown in FIG. 5, the orthogonal projection of the outer contour of the elastic support 10 in the vibration direction is oblong, wherein the oblong structure here refers to a structure which includes two parallel sides connected by arcs respectively.

Since the projection of the outer contour of the elastic support 10 in the vibration direction is rectangular or oblong, the elastic support having such a stereoscopic structure has higher vibration stability, ensures that the vibrator vibrates in the vibration direction and reduces the probability of polarization.

Preferably, the first fixing portion 101 of the elastic support 10 in the present embodiment is located in the middle of the elastic support 10, the second fixing portion 102 is located at the edge of the elastic support 10, and four straight sides at the edges of the second fixing portion 102 correspond to the straight sides of the rectangular bottom wall of the housing and are fixed to the edges of the bottom wall of the housing. Of course, the structure of the elastic support 10 may also adopt an arrangement mode in another embodiment, i.e., the second fixing portion 102 is located in the middle of the elastic support 10, the first fixing portion 101 is located at the edge of the elastic support 10, and four straight sides at the edges of the first fixing portion 101 correspond to the straight sides of the rectangular bottom wall of the magnetic circuit system and are fixed to the edges of the bottom wall of the magnetic circuit system.

Preferably, the housing is made of a metal material and comprises an upper housing 1 and a lower housing 2 which are coupled together. The elastic support 10 is arranged between the bottom wall 21 of the lower housing 2 and the magnetic circuit system. The first fixing portion 101 or the second fixing portion 102 is coupled to the bottom wall 21 of the lower housing 2 by laser welding. Compared with the prior art in which the elastic support and the housing are fixed by gluing, the present invention has the characteristics that the housing is made of a metal material, and the elastic support 10 is fixedly connected to the bottom wall 21 of the lower housing 2 by laser welding, such that the connecting strength is higher, and therefore, the elastic support 10 is unlikely to fall from the bottom wall 21 of the lower housing 2.

Figure 7:
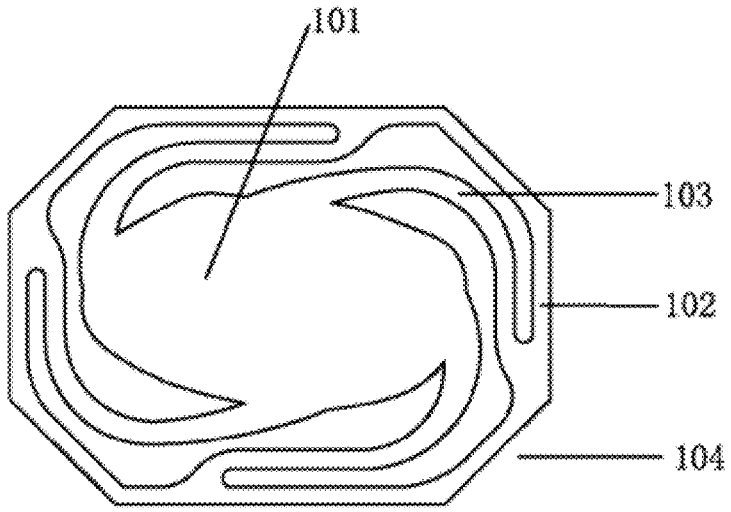
FIG. 7 is a schematic view of an octagonal structure of the elastic support of the multifunctional device of the present invention.

Preferably, an injection-molded part 22 which is integrally formed by injection molding is arranged at a corner of the metal housing, and the projection of the outer counter of the elastic support 10 in the vibration direction is of an octagonal structure which can make way for the injection-molded part 22. As shown in FIG. 7, on the basis that the orthogonal projection of the outer contour of the elastic support 10 having the octagonal structure in the vibration direction is of a rectangular structure in the present embodiment, a triangular region is cut from the junction of any two right-angle sides of the outer contour to form a make-way structure 104 and further generate the octagonal structure. Except for the octagonal structure, the elastic support 10 may be correspondingly set as any polygon according to the position of the injection-molded part in the metal housing, which will not be limited herein.

Preferably, the injection-molded part 22 and the lower housing 2 are integrally formed by injection molding. Some wedge-shaped sawteeth are arranged at a position where the injection molding 22 is connected with the lower housing 2. The lower housing 2 is provided with wedge-shaped grooves corresponding to said sawteeth. Such a structural design can enhance the injection molding strength between the injection-molded part 22 and the lower housing 2, and can prevent the injection-molded part 22 from being separated from the lower housing 2.

Figure 8:
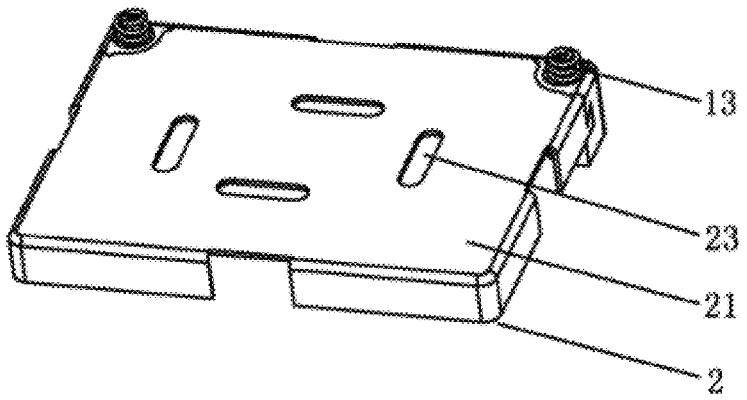
FIG. 8 is a schematic structural view of a lower housing of the multifunctional device of the present invention.

Preferably, as shown in FIG. 8, the magnetic conduction yoke 3 is fixedly coupled to the first fixing portion 101 or the second fixing portion 102 by laser welding, and a welding position, which corresponds to the magnetic conduction yoke 2 and the elastic support 10, of the bottom wall 21 of the lower housing 2 is provided with welding make-way holes 23. The number, shape and position of the welding make-way holes 23 may be correspondingly set on the bottom wall 21 of the lower housing 2 according to the specific welding position of the magnetic conduction yoke 3 and the elastic support 10, and will not be limited herein. In addition to having a welding make-way effect, the welding make-way holes 23 may also be configured to check a welding situation of the elastic support 10 and the magnetic conduction yoke 3.

Preferably, the elastic support 10 is of a spring-shaped structure, and the deformation portion 102 of the elastic support 10 is an arc-shaped elastic arm. Preferably, as shown in FIG. 3, arcuate transition portions 105 which reduce the stress concentration are arranged at the junctions between the deformation portion 103 and the first and second fixing portions 101 and 102, and are located at two sides of the deformation portion 103 in the direction of the section height. The arcuate transition portions 105 may be configured to effectively reduce the stress concentration of the junctions between the deformation portion 103 and the first and second fixing portions 101 and 102, enhance the fatigue resistance of the elastic support 10 and prolong the service life of the elastic support 10.

Preferably, the vibration diaphragm 8 is engaged to the sidewall of the upper housing 1, and a backing ring 11 is arranged between the vibration diaphragm 8 and the upper housing 1. The backing ring 11 may also be of a closed loop structure. The backing ring 11 may be arranged such that a gap is formed between the vibration diaphragm 8 and the upper housing 1 to prevent the vibration diaphragm 8 from directly contacting the upper housing 1 made of a metal material during vibration.

In addition, since the housing is made of a metal material in the present embodiment, an outer insulation layer of a lead of the voice coil 7 is likely to be crushed to cause short-circuits in case of adopting a traditional electrical connection manner. Therefore, the vibration and sound generation device of the present embodiment also has some improvements in the electrical connection manner. To be specific, a circuit board 12 is fixedly adhered to the inner side of the lower housing 2; in this way, the lead of the voice coil 7 may be fixed to a welding pad on the circuit board 12 by spot welding within the housing, and a spring 13 that extends to the outside of the lower housing 2 is welded to the circuit board 12 by reflow soldering; then the spring 13 and the external circuit are connected to completely realize the connection of an internal circuit and an external circuit. The spring 13, the welding pad of the circuit board and the injection-molded part 22 are all correspondingly arranged at the corners of the lower housing 2, without additionally occupying an internal assembly space thereof or affecting the volume of a magnetic circuit. Meanwhile, since the spring 13 is further fixed by the injection-molded part 22, the height of the spring 13 in the vertical direction exceeds the vertical space of the lower housing 2 to wrap a part of the spring 13, such that the spring 13 can be prevented from shaking. In the above-mentioned electrical connection manner, the welding pad electrically connected with the lead of the voice coil 7 is internally shrunk, such that the lead does not need to extend to the outer side of the housing to be subject to spot welding. In addition, in the presence of the injection-molded part 22 made of plastics, it is possible to ensure that static puncture is effectively prevented when the internal circuit and the external circuit are turned on.

The above contents are merely implementing cases of the present invention and are not intended to limit the present invention. All the equivalent modifications or variations that may be made by those of ordinary skill in the art in accordance with the content of the present invention are intended to be included within the scope of the claims.

What is claimed is:

1. A multifunctional device having a vibration function and a sound generation function, comprising a housing, as well as a vibration system, a magnetic circuit system and an elastic support which are accommodated inside the housing, wherein the magnetic circuit system is supported and fixed by the elastic support and is suspended inside the housing;

the vibration system comprises a vibration diaphragm and a voice coil coupled to one side of the vibration diaphragm; and wherein:

the elastic support comprises a first fixing portion, a second fixing portion, and a deformation portion which is connected between the first fixing portion and the second fixing portion;

an orthographic projection of an outer contour of the elastic support in a vibration direction is in a shape of a polygon defined by a plurality of straight lines or a geometrical shape defined by straight lines and arc lines; and the first fixing portion and the second fixing portion have a height difference there-between; and wherein:

the housing is made of a metal material and comprises an upper housing and a lower housing, a circuit board being fixedly adhered to an inner side of the lower housing:

a spring configured to connect the circuit board and an external circuit is welded to the circuit board and arranged at a comer of the lower housing: and an injection-molded part which is made of plastics is arranged at the corner of the lower housing and wraps a part of the spring.

2. The multifunctional device according to claim 1, wherein:

the orthographic projection of the outer contour of the elastic support in the vibration direction is of a rectangular or oblong structure;

the first fixing portion or the second fixing portion is located at the edge of the elastic support, and is at least provided with a group of straight sides which face each other; and the straight sides correspond to a group of straight sides, which face each other, of the bottom wall of the magnetic circuit system of the housing.

3. The multifunctional device according to claim 2, wherein the first fixing portion is located in the middle of the elastic support, the second fixing portion is located at the edge of the elastic support, and four straight sides at the edges of the second fixing portion correspond to the straight sides of the rectangular bottom wall of the housing and are fixed to the edges of the bottom wall of the housing.

4. The multifunctional device according to claim 2, wherein the second fixing portion is located in the middle of the elastic support, the first fixing portion is located at the edge of the elastic support, and four straight sides at the edges of the first fixing portion correspond to the straight sides of the rectangular bottom wall of the magnetic circuit system and are fixed to the edges of the bottom wall of the magnetic circuit system.

5. The multifunctional device according to claim 1, wherein:

the elastic support is arranged between the lower housing and the magnetic circuit system; and the first fixing portion or the second fixing portion is coupled to the bottom wall of the lower housing by laser welding.

6. The multifunctional device according to claim 5, wherein:

a position, corresponding to the corner of the housing, of the elastic support is provided with a make-way structure; and the orthogonal projection of the outer contour of the elastic support in the vibration direction is octagonal.

7. The multifunctional device according to claim 1, wherein:

the elastic support is of a spring-shaped structure, and the deformation portion is an arc-shaped elastic arm.

8. The multifunctional device according to claim 7, wherein arcuate transition portions which reduce the stress concentration are arranged at the junctions between the deformation portion and the first and second fixing portions.

9. The multifunctional device according to claim 1, wherein:

the vibration and sound generation device function further comprises a mass block which is coupled to the magnetic circuit system;

the magnetic circuit system comprises a flat magnetic conduction yoke, wherein a magnet is coupled to the center of the magnetic conduction yoke; and the mass block which is of a closed loop structure is coupled to the edge of the magnetic conduction yoke.

10. The multifunctional device according to claim 9, wherein:

the magnetic conduction yoke is coupled to the first fixing portion or the second fixing portion by welding; and a welding position, corresponding to the magnetic conduction yoke and the elastic support, on the bottom wall of the lower housing is provided with welding make-way holes.

* * * * *